US006317976B1

(12) United States Patent
Aranda et al.

(10) Patent No.: US 6,317,976 B1
(45) Date of Patent: Nov. 20, 2001

(54) METHOD OF MAKING A CATALYTIC CONVERTER FOR USE IN AN INTERNAL COMBUSTION ENGINE

(75) Inventors: Douglas A. Aranda, Lindley; Paul S. Schmitt, Big Flats, both of NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/465,733

(22) Filed: Dec. 17, 1999

Related U.S. Application Data

(60) Provisional application No. 60/113,904, filed on Dec. 28, 1998.

(51) Int. Cl.[7] ..... B21D 51/16

(52) U.S. Cl. ..... 29/890; 29/515; 29/465; 29/466

(58) Field of Search ..... 29/890, 428, 464, 29/465, 466, 469.5, 508, 521, 525.01, 890.08, 445, 515, 516; 422/179, 180, 221, 222

(56) References Cited

U.S. PATENT DOCUMENTS

| | | | |
|---|---|---|---|
| 3,441,382 | 4/1969 | Keith et al. | 23/288 |
| 3,958,312 | 5/1976 | Weaving et al. | 29/157 R |
| 4,093,423 | 6/1978 | Neumann | 23/288 FC |
| 4,239,733 | 12/1980 | Foster et al. | 422/179 |
| 4,750,251 | 6/1988 | Motley et al. | 29/157 R |
| 4,782,661 | 11/1988 | Motley et al. | 60/299 |
| 4,925,634 | 5/1990 | Yokokoji et al. | 422/179 |
| 4,985,212 | 1/1991 | Kawakami et al. | 422/179 |
| 5,055,274 | 10/1991 | Abbott | 422/179 |
| 5,082,479 | 1/1992 | Miller | 55/523 |
| 5,273,724 | 12/1993 | Bos | 422/179 |
| 5,666,726 | 9/1997 | Robinson et al. | 29/890 |
| 5,729,902 | 3/1998 | Wieres et al. | 29/890 |

FOREIGN PATENT DOCUMENTS

| | | |
|---|---|---|
| 0 299 626 | 1/1989 | (EP) . |
| 9702414 | 1/1997 | (WO) . |

OTHER PUBLICATIONS

Nonnenmann M: "Metal Supports for Exhaust Gas Catalysts", SAE Transactions, vol. 94, 1985, pp. 1.814–1.812, XP000677863.

*Primary Examiner*—S. Thomas Hughes
*Assistant Examiner*—Marc W. Butler
(74) *Attorney, Agent, or Firm*—Timothy M. Schaeberle

(57) ABSTRACT

The invention is directed at a method of manufacturing these catalytic converters having non-round honeycomb substrates and comprises the following steps: (1) wrapping a non-round monolithic ceramic substrate, having a major and minor orthogonal axis, in a sufficient amount of the supporting mat material whereby the substrate's peripheral surface is substantially covered; (2) inserting the wrapped substrate into a metal shell, having a plurality of nodal points, which substantially surrounds the wrapped substrate; (3) placing the metal shell in a resizing die having a plurality of fingers, and associated gaps therebetween, extending axially along substantially the entire surface of the metal shell whereby the nodal points of the metal shell are positioned along a portion of a die finger and the placement of the metal shell and wrapped substrate, within the resizing die is such that the axes of the resizing die are angularly offset from the major and minor axes of the substrate; (4) compressively closing the container around the wrapped substrate by displacing the fingers of the resizing die radially inward to provide a gas tight seal and to hold the compressive stress by; and, (5) securing the metal shell to provide a gas tight seal and to hold the compressive stress.

4 Claims, 2 Drawing Sheets

METHOD OF MAKING A CATALYTIC CONVERTER FOR USE IN AN INTERNAL COMBUSTION ENGINE

This application claims the benefit of U.S. Provisional Application No. 60/113,904, filed Dec. 28, 1998, entitled "Method of Making a Catalytic Converter for Use in an Internal Combustion Engine ", by Aranda et al.

BACKGROUND OF THE INVENTION

1. Field of the Invention

The invention relates to catalytic converters for purifying exhaust gases, and more particularly to method for forming catalytic converters having non-round honeycomb substrates wherein the method results in minimal buckling of the converter's metal shell and uniform compressive forces being exerted on the encircling mat and the honeycomb substrate.

2. Description of the Related Art

As is well known, the purification of exhaust gases from internal combustion engines, particularly in motor vehicles, is generally achieved by an exhaust gas purification system in which a ceramic element having a honeycomb cell structure acts a catalyst carrier. More precisely, this honeycomb cell structure is covered with a catalyst, that contains a precious metal which functions, in the presence of $O_2$, to convert noxious components of the exhaust gas, such as HC and CO, to $CO_2$ and $H_2O$. The honeycomb cell structure is housed within a gas-tight, sheet metal or cast-metal heat resistant housing or can or shell.

Honeycomb structures currently employed are typically comprised of a ceramic material such as cordierite; a brittle material exhibiting limited mechanical strength. For this reason, catalytic converters in use today, typically include a supporting mat that is wrapped around the periphery of the honeycomb. This resilient material, which distributes any compressive forces uniformly on the ceramic, typically expands as the temperature increases. This being the case, the compressive supporting pressure on the honeycomb therefore increases at elevated temperatures, and in some degree compensates for the thermal expansion of the outer metal shell. Since the metal shell expands more than the enclosed ceramic honeycomb, this mat expansion with temperature rise prevents the honeycomb from becoming loose in the shell.

There are known in the art various methods of fabricating catalytic converters as described above, including inserting tight-fitting mat-wrapped honeycombs into tubular shells (see, for example U.S. Pat. No. 4,093,423 (Neumann)), as well as utilizing two metal shell halves which are closed around a mat-wrapped honeycomb and thereafter welded together; see for example U.S. Pat. No. 5,273,724 (Bos). Another such method of fabrication, commonly referred to as the "tourniquet wrap" method involves forming a rectangular flat-sheet metal piece into a cylindrical body having a lap joint. A mat-wrapped honeycomb is loosely inserted into the cylindrical metal can and the combined assembly is pulled together to form the desired mat compression. Thereafter, the lap joint is welded together thereby holding the can at the desired compression while at the same time preventing gas leakage; see for Example U.S. Pat. No. 5,082,479 (Miller).

Although round substrates have some advantages in terms of uniform mounting and fundamental strength, the available space in an under-car and motorcycle applications has lead to the use of non-round shapes which are capable of providing sufficient catalyst surface area within the limited under-car and motorcycle space available. An inherent deficiency of the aforementioned formation techniques when used for non-round, oval or similar, shapes is uneven or non-uniform compressive closing of the encircling mat. Specifically, the mat portion located along the substrate's flatter side, i.e., along the minor axis, is less compressed than those rounder, smaller end portions of the substrate, i.e., along the major axis. On the one hand, the inadequate compression of the flatter sides results in an axial retention, i.e., the restraining forces which hold the substrate in place, which is decidedly lower than desirable and thus decreases product durability. On the other hand, the over-compressed small ends, areas where the mat gap is the small, lead to an increased risk of substrate failure due to point loading and localized compressive failure of the honeycomb structure, i.e., crushing of the brittle honeycomb structure.

This non-uniform compression problem has been addressed by various means including the use of deformed metal cans which provide less clearance along the flat sides, as well as the use of ribbing in the configuration which increases the rigidity of the can in the flatter areas.

A recent innovation disclosed in U.S. patent application Ser. No. 09/013,976 (Schmitt) discloses a method for manufacturing a catalytic converter having a non-round monolithic ceramic substrate. The first step of the method involves wrapping a non-round monolithic ceramic substrate in a sufficient amount of supporting mat material to substantially cover the peripheral surface of the substrate. Next, the wrapped substrate is thereafter inserted into a metal shell that substantially surrounds the wrapped substrate and at least one force redistribution plug is placed on the peripheral surface of the metal shell. Lastly, the metal shell is compressively closed around the substrate and the metal shell is secured to provide a gas tight seal and to hold the compressive stress.

This method generally results in a more uniform compression being exerted on the wrapped substrate, however, the metal shell, upon compression, is subject to unbalanced forces at the nodal points of these oval converters, i.e., points where the curvature of transitions from a small to large curvature. The result of these unbalanced forces is that the metal shell is typically subject to buckling along its periphery. Although this method alleviates the over/under compression problem somewhat, the method is unnecessarily complex, and is subject to the aforementioned buckling, and as such the search for better and simpler solutions to uniform oval canning has continued.

SUMMARY OF THE INVENTION

It is therefore an objective of the present invention to overcome the problems and shortcomings inherent in current methods of forming non-round catalytic converters; i.e., buckling or deformation of the metal shell upon compression. In other words, the formation of non-round catalytic converters that results in balanced forces being exhibited upon the metal shell upon compression and which exhibits a substantially uniform compressive load upon the encircling mat and the honeycomb structure thereby avoiding localized compressive failure, inadequate axial retention of the honeycomb substrate, and buckling of the metal shell.

This objective, as well as other objectives which will become apparent in the discussion that follows, are achieved, in accordance with the present invention by utilizing a resizing die, in the compressive closing formation, which effectively results in both balanced forces being exerted on the metal shell and uniform compression of the honeycomb substrate. In general, the method of manufacturing these catalytic converters having non-round honeycomb substrates comprises the following steps: (1) wrapping a non-round monolithic ceramic substrate, having a major and a minor orthogonal axis, in a sufficient amount of the supporting mat material whereby the substrate's peripheral surface is substantially covered; (2) inserting the wrapped substrate into a metal shell, having a plurality of nodal points, and which substantially surrounds the wrapped substrate; (3) placing the metal shell in a resizing die having a plurality of fingers, and associated gaps therebetween, extending axially along substantially the entire surface of the metal shell whereby the nodal points of the metal shell are positioned along a portion of a die finger and the placement of the metal shell and wrapped substrate, within the resizing die is such that the axes of the resizing die are angularly offset from the major and minor axes of the substrate; (4) compressively closing the metal shell around the wrapped substrate by displacing the fingers of the resizing die radially inward to provide a gas tight seal and to hold the compressive stress by; and, (5) securing the metal shell to provide a gas tight seal and to hold the compressive stress.

BRIEF DESCRIPTION OF THE FIGURES

FIG. 1 represents an uncompressed illustration of the catalytic converter in the resizing die, while FIG. 2 represents a fully compressed catalytic converter in the resizing die.

DETAILED DESCRIPTION OF THE INVENTION

Figure 1:
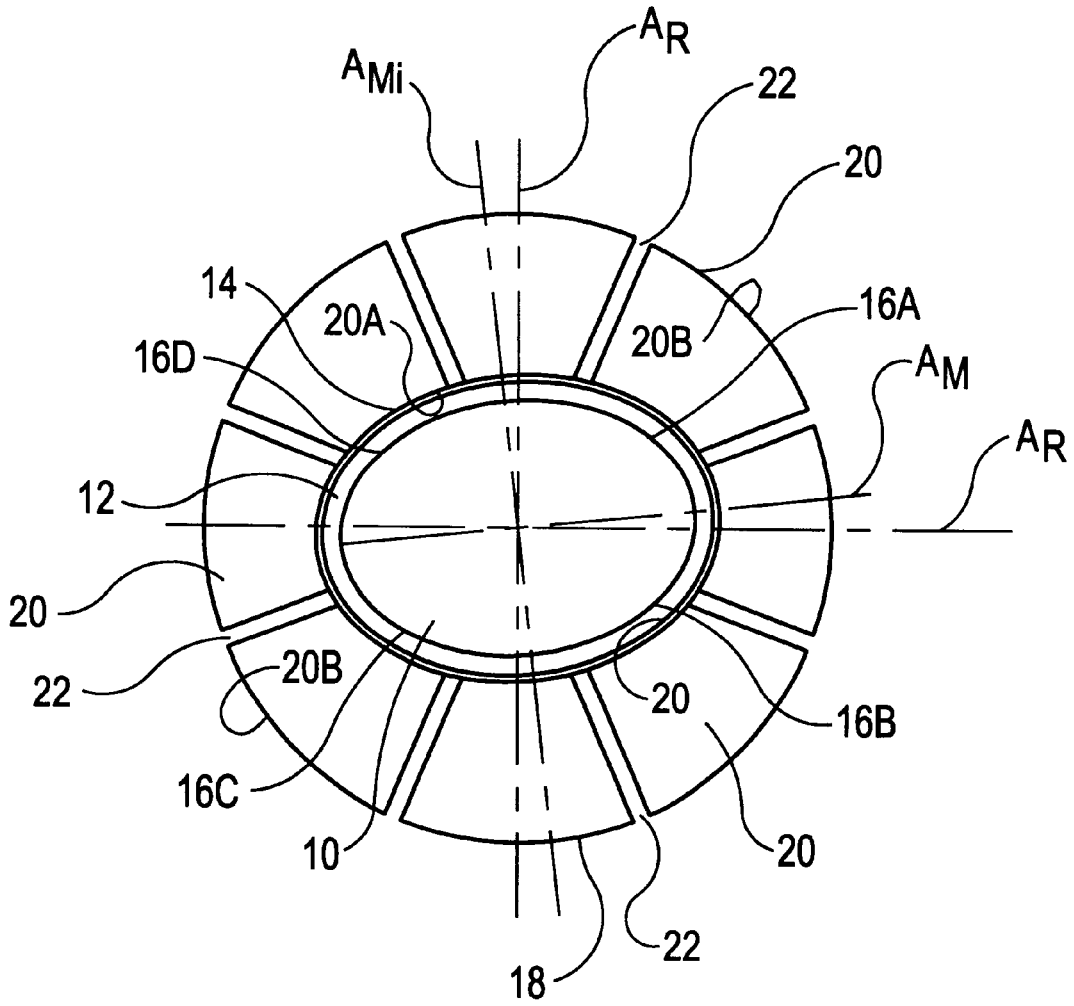
FIGS. 1 and 2 illustrate schematic longitudinal views of the present invention for forming a non-round substrate-containing catalytic converter.
Figure 2:
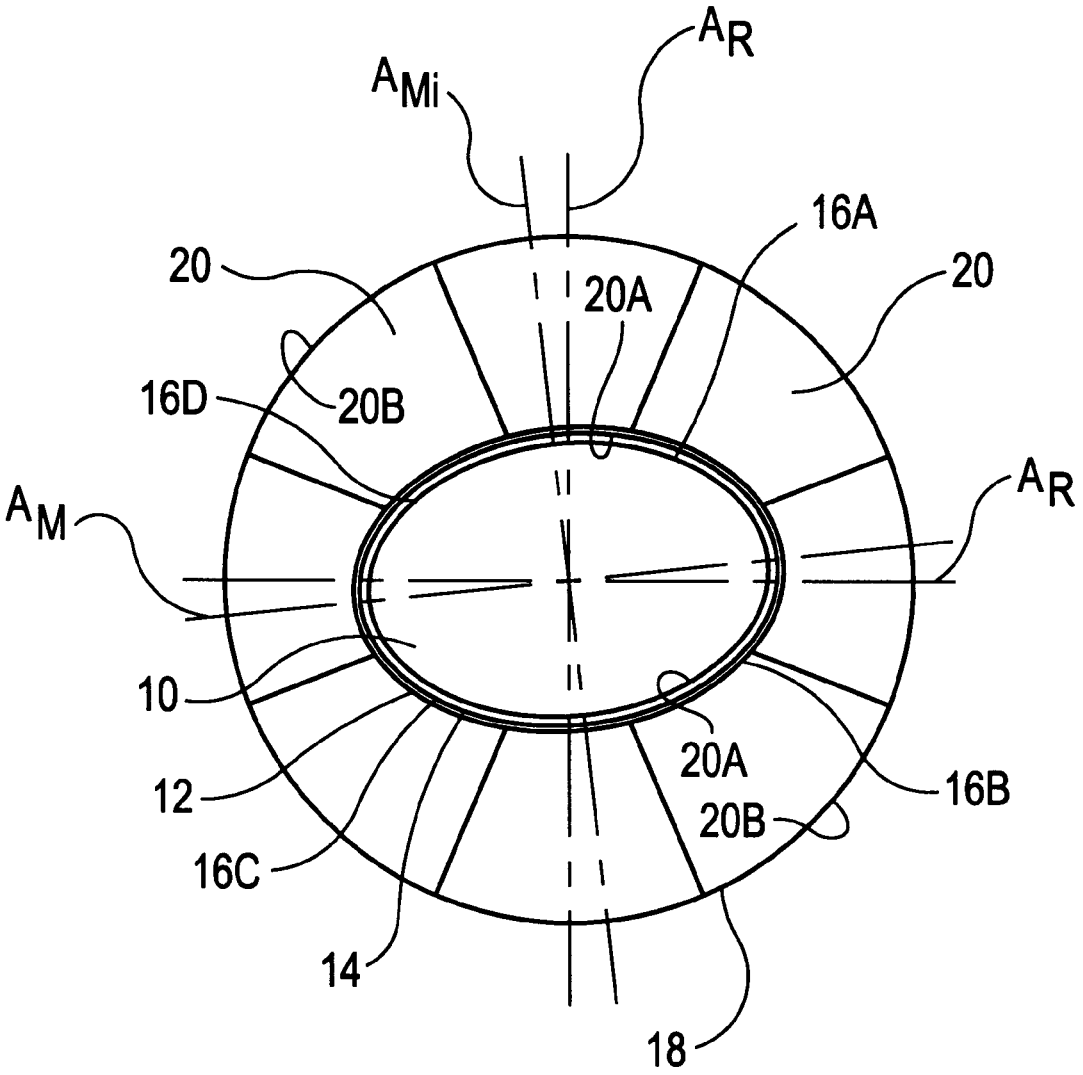

FIGS. 1 and 2 illustrates the fabrication of the catalytic converter according to the invention described herein. Referring specifically to FIG. 1, a non-round monolithic ceramic substrate 10 is wrapped in a sufficient amount of the supporting mat material 12 whereby the substrate's 10 peripheral surface is substantially covered. Mat 12 comprises a formed ceramic fiber material, either a simple non-expanding ceramic material, an intumescent material, e.g., one which contains a vermiculite component that expands with heating to maintain firm compression when the outer steel expands outward from the ceramic monolith, as well as mats which include a combination of both. Acceptable non-expanding ceramic fiber materials include ceramic materials such as those sold under the trademarks "NEXTEL" and "SAFFIL" by the "3M " Company, Minneapolis, Minn. or those sold under the trademark "FIBERFRAX" and CC-MAX by the Unifrax Co., Niagara Falls, N.Y. Acceptable intumescent ceramic materials include those sold under the trademark "INTERAM" by the "3M" Company, Minneapolis, Minn., as well as those intumescents which are also sold under the aforementioned "FIBERFRAX" trademark.

The substrate 10, as wrapped, is thereafter inserted into a metal shell 14 that includes a plurality of nodal points 16A, 16B, 16C, 16D and which substantially surrounds the wrapped substrate- Nodal points as defined herein are those points where the curvature of transitions from a small curvature to large curvature. Suitable materials for the shell 14 comprise any material which is capable of resisting under-car salt, temperature and corrosion; ferritic stainless steels including grades SS-409, SS-439, and more recently SS-441 are however, generally preferred. The choice of material depends on the type of gas, the maximum temperature and the like.

The oval ceramic honeycomb substrate 10, exhibits a major orthogonal axis ($A_M$) and a minor orthogonal axis ($A_{Mi}$). Ceramic substrates suitable for use in the present invention may be formed from any ceramic material conventionally used for this purpose such as is disclosed, for example in U.S. Pat. No. 3,885,977 or U.S. Pat. No. Reissue No. 27,747. Preferably, an extruded cordierite ceramic substrate having a high mechanical integrity, low resistance to gas flow and a high geometric surface area is utilized as the substrate. One important parameter for the ceramic substrate is it's mechanical integrity, in particular it's radial strength. Typical cordierite honeycomb substrates are capable of easily withstanding more than 4826.5 kPa (700 psi) of radial pressure before noticeable damage to the honeycomb occurs. Ceramic honeycomb typically comprises square cells, although the cells of the honeycomb may have shapes other than square, including triangular, rectangular and the like. In consideration of the tooling costs for extrusion molding or the like, however the cells are generally square in shape.

Referring still to FIG. 1, the wrapped substrate having been placed into the metal shell is thereafter placed into a resizing die 18 for subsequent compression to form the catalytic converter. The resizing die includes a plurality of adjacent resizing fingers 20, and associated gaps therebetween 22. When the resizing die 18 is open, as it appears in FIG. 1 the interior surface 20A of the fingers 20 and the associated gaps 22 combine to form an oval which is slightly larger than the metal shell 14 with the wrapped substrate 10 inserted therein. Put differently, the resizing fingers 20 and associated gaps 22 of the resizing die 18 combine to extend axially along substantially the entire surface of the metal shell 14. However, when closed completely (see FIG. 2), the gaps 22 close and the contour of the fingers interior surface 20A corresponds to the desired final curvature and size of the converter. In a preferred embodiment, the outer surface 20B of the adjacent resizing fingers 20 forms a round contour which is important feature in the subsequent compression step.

The placement of the wrapped substrate and metal shell within the resizing die is critical to the formation of a catalytic converter that exhibits little, if any, buckling or deformation of the metal shell upon compression. Specifically, in the placement of the wrapped substrate within the resizing die there are two essential conditions that must be maintained in arranging the gaps in the resizing die relative to the oval contour of the metal shell and its nodal points. Firstly, placement of the wrapped substrate 10 and metal shell within the open resizing die 18 should be such that the nodal points 16 of the metal shell 14 are positioned along a portion of a die finger 20. Put differently, each nodal point 16A–D on the metal shell is positioned relative to the gaps 22 such that no nodal point is coincident with a gap. There is an increased susceptibility to shell buckling at the nodal points. Since the shell is relatively unsupported by the resizing die finger 20 at the gap, this requirement ensures that portion of the shell most vulnerable to buckling is not located at the region with minimum support from the resizing die.

Secondly, the placement of the metal shell 14 and ed substrate 10 within the resizing die 18 is such that the axes of the resizing die ($A_R$) are not symmetrically positioned in relation to the wrapped substrate and metal skill. Put differently, the placement of the wrapped substrate whereby the axes of the resizing die ($A_R$) are not symmetrically positioned along the wrapped substrate ensures that the gaps 22 of the resizing die are not symmetrically positioned along the wrapped substrate. With this alignment, the method is capable of reducing any bulging that occurs at the perimeter of the shell in the position of the gaps 22. Specifically, a resized part may be flipped in orientation and thereafter resized a second time. Since there is no symmetry of the gaps and the axes of the shell along the wrapped substrate and metal shell, each location on the shell perimeter which previously was at a gap 22 is subsequently located away from a gap in the resizing fingers. Any slight bulge in the shell perimeter will be reshaped by the contour of the finger towards a more ideal curvature.

It has been discovered that by maintaining an angular offset between the axes of the resizing die ($A_R$) and the major orthogonal axis ($A_M$) of oval ceramic honeycomb substrate 10 each of the aforementioned positioning objectives can be achieved. Simply stated, this angular offset accomplishes the both the objective that each nodal point on the metal shell is positioned relative to the gaps 22 such that no nodal point is coincident with a gap, and simultaneously the objective that the gaps 22 and the axes of the resizing die ($A_R$) are not symmetrically aligned along the metal shell and wrapped substrate. Preferably, the angular offset between the axes of the resizing die and the axes of the substrate is at least 5°, however the angular offset between the axes can be as great as between 8 to 15°.

When the can is in its open position (See FIG. 1) and the gaps 20 between the adjacent fingers 22 are at their largest, the curvature of the resizing ring interior surface 20A is greater than the corresponding curvature of the metal shell, and as such there is excessive line contact of the resizing die finger 20 corners on the metal shell 14 and thus excessive friction upon compressive closing. Smoothing the ends of the fingers so that the radius more closely matches that of the metal shell, results in a reduction of the compressive closing friction.

Referring now specifically to FIG. 2, once the wrapped substrate 10 is correctly positioned within the open resizing die 18, as described above, the next step involves compressively closing the metal shell 14 around the as-wrapped substrate 10 to a desired target mat compression, by displacing the fingers 22 of the resizing die 18 radially inward. This compressive closing can be accomplished through the use of a circular, tapered compressing ring (not shown) that is placed on the outside surface of the round resizing die 18 which forces the fingers 20 of the resizing die 18 radially inward. When the ring is pushed over the metal shell, the tapered compressing ring hole forces the metal shell to a smaller size. The large scale deformation of the shell 14 results in permanent plastic deformation of the shell to new, smaller contour which is correctly shaped to provide the desired uniform compression of the surrounding mat support to optimally hold the substrate in position. The compression of the resizing die is subsequently reversed to release the ideally formed shell from the die.

In a preferred embodiment, and as mentioned above, after the metal shell/wrapped substrate assembly is compressed a first time, the compressed metal shell/wrapped substrate assembly is removed from the resizing die, rotated 180° and reinserted into the resizing die and subject to compression in the same manner as previously described. The result of this second compression step is that any minor bulge that has developed in the first compression step, as a result of alignment with a gap, is repositioned along, and is contact with, the interior surface 22A of a resizing finger. This second compression step will then function to reform and repair the bulge or buckle that was formed in the first compression step.

EXAMPLE

A catalytic converter having an oval substrate exhibiting a major axis diameter of 103 mm and a minor axis diameter of 76.2 mm, and having a length of 73 mm, was formed in the manner described above; utilization of an 8-finger resizing die. One minor, though acceptable bulge or buckle was detected in the can after formation. Specifically, the converter was compressively closed so as to achieve a target mat compression of 0.60 g/cc.

The substrate mat was comprised of an non-intumescent ceramic material of weight basis 2182 g/m$^2$ sold under the trademark "CC-MAX" by the Unifrax Co., Niagara Falls, N.Y., while he metal shell was comprised of 1.2 mm thick ferritic stainless steel, grade SS-409.

The so-formed catalytic converter's mat gap was measured at 8 equally spaced places along the periphery of both ends, front and rear, and reported in Table I; the ends opposite each along the major orthogonal axis being 0 and 180°, respectively. These mat gap measurements were utilized to generate average gap bulk density measurements for the front, the rear and for the overall dimensions; 0.57 g/cc, 0.54 g/cc and 0.56 g/cc, respectively. The gap density was calculated by dividing the nominal mat weight basis of 2182 g/m$^2$ by the each of the eight mat gap measurements. The so-formed catalytic converter of the example has a mat gap and gap bulk density variability, which are much improved over that which is typical for an oval substrate tourniquet wrap canned without the use of the resizing die method and, and which approaches the variability typically exhibited by round tourniquet canned substrates.

Table II reports the overall so-formed converter measured major and minor axis dimension (mm), front and rear position, as well as the perimeter dimension (mm). Furthermore, Table II reports the nominal dimension of each of the these dimensions. The variation of these axis from that of nominal is acceptable and approaches the variability typically exhibited by round tourniquet canned substrates.

TABLE I

| POSITION (°) | MAT GAP, FRONT (mm) | MAT GAP, BACK (mm) |
|---|---|---|
| 0 | 3.88 | 3.46 |
| 45 | 3.72 | 3.38 |
| 90 | 4.12 | 4.15 |
| 135 | 3.69 | 4.33 |
| 180 | 3.61 | 4.54 |
| 225 | 3.60 | 3.46 |
| 270 | 3.66 | 3.93 |
| 325 | 4.25 | 4.24 |

TABLE II

| | NOMINAL | FRONT | REAR |
|---|---|---|---|
| MAJOR AXIS DIMENSION (mm) | 4.458 | 4.461 | 4.439 |
| MINOR AXIS DIMENSION (mm) | 3.403 | 3.388 | 3.384 |
| PERIMETER (mm) | 316.0 | 315.8 | |

It is to be understood that the present invention is not limited to the diments described above, and that various changes and modifications may be ted therein by one skilled in the art without departing from the intended scope or of the invention.

We claim:

1. A method of manufacturing a catalytic converter for purifying exhaust gases from an internal combustion engine, the converter having a monolithic ceramic substrate surrounded by a supporting mat, comprising the steps of:

wrapping a non-round monolithic ceramic substrate, having a major and a minor orthogonal axis and a peripheral surface, in a sufficient amount of the supporting mat material to substantially cover the substrate peripheral surface inserting the wrapped substrate into a metal shell having an external surface and a plurality of nodal points, the metal shell substantially surrounding the wrapped substrate;

placing the metal shell in a resizing die exhibiting a pair of axes and having a plurality of adjacent fingers and associated gaps therebetween, the adjacent fingers extending axially along substantially the entire external surface of the metal shell whereby the nodal points of the metal shell are positioned along a portion of a die finger and the placement of the metal shell and wrapped substrate within the resizing die results in the axes of the resizing die being angularly offset from the major and minor orthogonal axes of the wrapped substrate;

compressively closing the metal shell around the wrapped substrate by displacing the fingers of the resizing die radially inward to provide a gas tight seal and to impart a desired mat compression; and securing the metal shell to provide a gas tight seal and to hold the desired mat compression.

2. The method of claim 1 wherein the angular offset between the axes of the resizing die and the axes of the substrate is at least 5°.

3. The method of claim 1 wherein the angular offset between the axes of the resizing die and the axes of the substrate is between 8 to 15°.

4. The method of claim 1 wherein subsequent to compressively closing the metal shell around the wrapped substrate but prior to the securing of the metal shell, the metal shell and wrapped substrate are removed from the resizing die, rotated 180° and reinserted into the resizing die and thereafter compressed a second time.

* * * * *